United States Patent [19]

Pole

[11] Patent Number: 4,706,854

[45] Date of Patent: Nov. 17, 1987

[54] PARTICULATE MATERIAL HANDLING

[75] Inventor: Charles D. Pole, Willowdale, Canada

[73] Assignee: ULS International Inc., Toronto, Canada

[21] Appl. No.: 826,200

[22] Filed: Feb. 5, 1986

[30] Foreign Application Priority Data

Mar. 29, 1985 [CA] Canada ..... 477953

[51] Int. Cl.[4] ..... B65D 47; B65D 00

[52] U.S. Cl. ..... 222/459; 222/486; 222/502; 222/508; 222/556; 222/560; 105/253; 105/283; 105/287; 414/140; 414/145

[58] Field of Search ..... 222/226, 247, 248, 459, 222/502, 503, 508, 556, 560, 547, 564, 485, 486; 414/145, 144, 140, 288, 328; 105/283, 253, 284, 287, 247, 282 R

[56] References Cited

U.S. PATENT DOCUMENTS

| | | | |
|---|---|---|---|
| 1,385,254 | 7/1921 | Lüft | 222/459 |
| 1,663,173 | 3/1928 | Pioda | 222/459 |
| 1,745,716 | 2/1930 | Rynders | 222/459 |
| 2,741,464 | 4/1956 | Conover | 222/459 X |
| 3,561,368 | 2/1971 | Giesking | 105/287 X |
| 3,776,142 | 12/1973 | Molloy et al. | 105/284 X |
| 4,004,700 | 1/1977 | Empey | 414/144 |
| 4,583,901 | 4/1986 | Tyrer | 414/144 |

FOREIGN PATENT DOCUMENTS

| | | | |
|---|---|---|---|
| 1223099 | 6/1960 | France | 222/459 |

*Primary Examiner*—Joseph J. Rolla
*Assistant Examiner*—David H. Bollinger
*Attorney, Agent, or Firm*—Bachman & LaPointe

[57] ABSTRACT

Apparatus and method for containing and feeding particulate material tending to pack into a mass from an elongated hopper having opposed sloping walls converging downward and inward towards each other to terminal margins presenting between them an elongated laterally restricted outlet for directing material onto a conveyor below. Gates are provided to close the outlet for containing the material and to open the outlet to discharge it onto the conveyor belt. Baffles within the hopper are provided to divide the cargo at a level spaced above the outlet into several piles which merge above and below the outlet. In this way the material is channelled to the outlet so that lateral arches which may be formed in the material are prevented or broken up to assure feeding. Pressure may be relieved on some of the piles by flanges extending laterally of the baffles. The invention also includes the combination of gates equipped to break up longitudinal arches with baffles to prevent the formation of lateral arches.

11 Claims, 7 Drawing Figures

FIG. 3
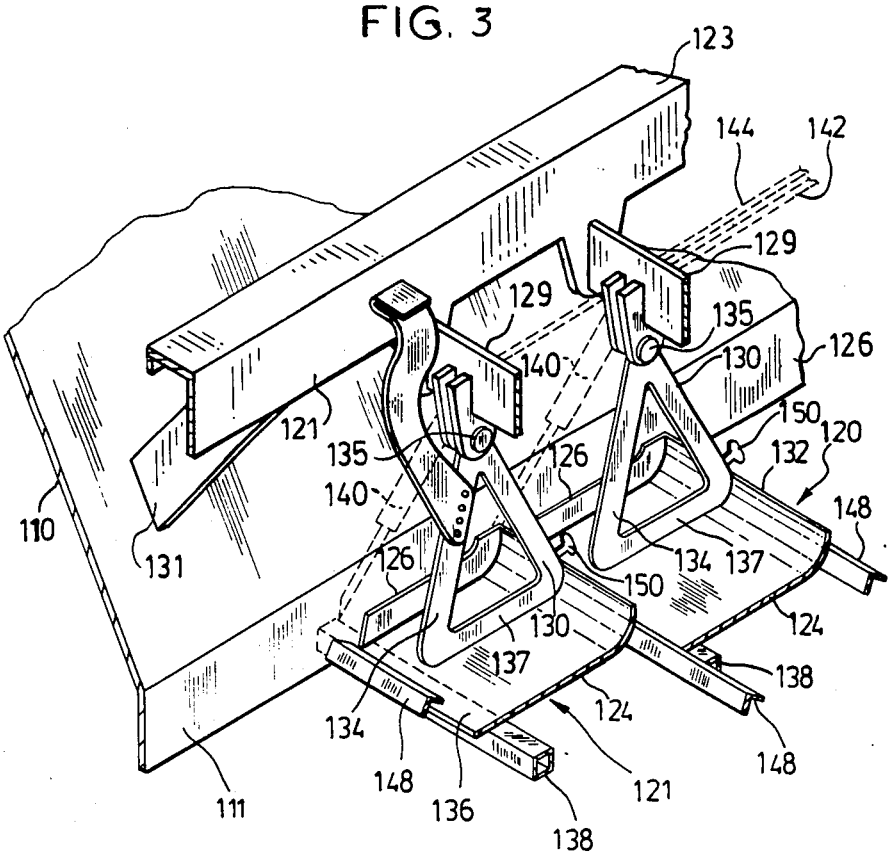
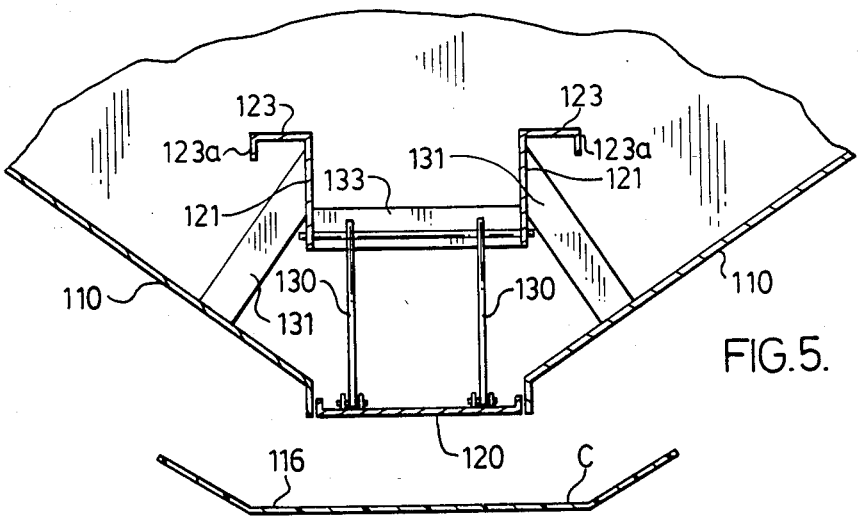
FIG.5.

PARTICULATE MATERIAL HANDLING

BACKGROUND OF THE INVENTION

1. Field of the Invention

This invention relates to an apparatus and method for unloading from cargo holds or hoppers, cargoes of solid particulate material, especially those referred to in the trade as "sticky".

Particulate material has characteristics which make it difficult to unload from hoppers because of the arching or bridging phenomenon.

2. Description of the Prior Art

The arching or bridging phenomenon is discussed in some detail in U.S. Pat. No. 3,797,707, Jenike and Johanson (1974). The problem of unloading particulate material from hoppers and means of overcoming it is also discussed in "Bulk Solids Handling (The International Journal of Storing and Handling Bulk Material)", Vol. 5, No. 3, June 1985, published in English by Trans Tech Publications, D-3392 Clausthal-Zellerfeld, Federal Republic of Germany. See specially pages 623, 627, 629 and 633 to 640. See also the chapter "Self-Unloading Vessels" by Walker at pages 565 to 569. The literature referred to is hereby incorporated by reference.

Self-unloading seagoing and lakegoing vessels which carry particulate materials in bulk are equipped with large elongated hoppers having inwardly and downwardly sloping sides leading to an outlet overlying a conveyor. A simplified view of a self-unloading vessel is contained in U.S. Pat. No. 2,815,134, Borrowdale (1957). The vessel illustrated is, of course, much smaller than the typical vessels the applicant is talking about and only two side-by-side hopper outlets are shown, but the patent does serve to give a general idea of the type of vessel to which the invention applies and of the unloading problem.

SUMMARY OF THE INVENTION

The present invention is particularly applicable to self-unloading seagoing and lakegoing vessels having a length of 700 to 800 feet and a width of 75 to 100 feet. A typical vessel of this type will have a cargo space of some 500 feet long divided fore and aft by bulkheads into, say, five holds each about 100 feet long. Two conveyor belts, one at each side of the vessel, extend the entire length of the cargo space underneath the holds and beneath the bulkheads separating them. In this typical vessel, each hold has a pair of side-by side hoppers about 40 feet wide at the top with sides sloping inward at a downward angle of as little as 35° towards an outlet about 4½ to 6 feet wide. The shallow slope is to avoid losing cubic capacity, that is, to use as much of the hold space as possible for the cargo. These hoppers may have a head of 30 or 40 feet of material above a long discharge channel closed by gates which form a floor which opens to allow the escape of material.

The outlet to the hopper is controlled by gates, for example, swing gates are preferably used, as shown in my prior U.S. Pat. No. 4,574,989, issued Mar. 11, 1986, which disclosure is hereby incorporated by reference. There may be several swing gates in a row, in some cases as many as 30, and could be as few as 3, preferably of the type shown in the prior application. There is a sliding gate with every bank of swing gates. Usually there are at least 2 swing gates, often more, and 1 sliding gate in a bank. The swing gates are adapted to swing between a position in which they close the opening and a position where they swing upward to disturb the material in the bottom of the hopper to facilitate its flow. It may be desirable to have one horizontally sliding gate at the upstream end of the hopper or after each bank of several swing gates. The sliding gate does not meet the resistance of the material so that it may be opened independently of the swing gates so as to allow a certain amount of material to flow out and facilitate the entry of the swing gates into the body of the material.

Each ship has to be fitted to handle a whole range of particulate cargo, running from very fine material or dust up to lumps of 8 to 15 inches in diameter. For example, gypsum limestone may contain 10% by weight of lumps of this size.

More specifically, the containing and discharging arrangement to which this invention applies includes an elongated hopper for positioning above an elongated conveyor belt extending in a substantially horizontal direction from an upstream end to a downstream end. The hopper has a discharge structure including opposed downwardly and inwardly sloping sides, extending towards each other to terminate in elongated parallel margins, defining between them an elongated discharge channel to overlie the conveyor. Transverse spaced-apart members extend between the respective margins to divide the discharge channel into a series of discrete outlets in the direction of the belt providing, together, a long narrow outlet. Gate means for each discrete outlet forms part of a floor of the hopper, when closed and, when opened, allows a controlled discharge of the material from the outlet as it gravitates from the sloping sides.

Generally speaking, in an unloading operation, sticky particulate material tends to pack in the hopper forming a natural self-supporting arch over the outlet which causes a no-flow condition. The nature of the arch (size, etc.) depends on the particular material, its moisture content, particle size, shape and uniformity of the particles, degree of compactability, the presence of lumps of agglomerated material, content of foreign matter, the head of material above, and other factors. Identical particulate material behaves exactly in the same way in identical hoppers in terms of forming an arch of identical dimensions because each given material has its own maximum arch span. A decrease or increase in moisture content changes the natural span of the arch. The arch for each particulate material has a maximum span, sometimes as much as 12 feet in diameter. And, if it were possible to make the discharge opening big enough, that is greater than the maximum arch span, this would prevent the arch from forming. This is not practical since, in many cases, the span would be too great, say 12 feet. It would not be practical to have a 12 foot wide belt.

It is possible to increase the effective opening of the hopper in the direction of the belt parallel to its line of travel by an appropriate gating system. For example, in my prior U.S. Pat. No. 4,574,989, issued Mar. 11, 1986 (disclosure incorporated by reference), the length of the outlets in the longitudinal direction is effectively increased, by providing each outlet with a number of swing gates, preferably pivotally mounted on an axis spaced above the outlet. The applicant also shows these gates applied in conjunction with a conventional sliding or roller track gate. Two or more swing gates are positioned ahead of a sliding gate to provide, in effect, an elongated outlet of such dimensions as to be greater than the fore and aft span of the maximum arch of the material.

This gating means has been found effective in breaking up lengthwise or fore and aft arching resulting from the compacting of the particulate material, as described. However, the applicant has found that there is occasionally the problem of material arching in the other direction between thetwo hopper slopes, that is, athwartships or at right angles to the fore and aft direction of the belt. And, for fully effective discharge from the hopper of "sticky" material, both the fore and aft and athwartships arching must be dealt with.

It is an aim of the present invention to improve the flow of material from the hopper by interfering with the natural athwartships consolidation of the particulate material into an arch between the sloping side surfaces of the hopper and also to combine this action with means for disturbing the natural fore and aft arching formation of the particulate material.

The applicant's prior U.S. Pat. No. 4,574,989, describes the opening of the gates to allow flow of material through the outlet of the hopper and the simultaneous disturbing of the material above the outlet to break up the fore and aft arch formations. Breaking up athwartships arches, in accordance with a preferred aspect of the invention, is done as follows.

When the gates open, the natural flow of particulate contents of the hopper is divided into a central stream of somewhat the width of the outlet, centrally of the hopper, by dividing a central space along its length in the up and down direction. This may be done with parallel spaced-apart elongated walls or baffles cutting across the normal arc of arch formation and providing a central channel and flanking channels each having an entrance centrally of the mass of material in the hopper and an outlet into a common channel spaced above the outlet of the hopper.

Preferably, there is structure to relieve pressure on the material in part of at least one lateral channel, preferably both, to keep the material relatively loose. This structure may take the form of baffles, each having a laterally extending flange or pressure shield at or near their top margins.

As explained elsewhere in this disclosure, each particulate material has the phenomenon of forming an arch of consolidated material of particular width depending on the material. The present invention and the previous invention (relating to breaking up the fore and aft arching), aim to provide an opening which is effectively at least 20 feet long so as to be greater than any arch which might be formed by the material. When the gates are opened in any outlet, material immediately above the gates will fall through the outlet onto the belt, vacating the space above the outlet into which material between the verticalbaffles will fall next. Then material between the hopper slopes and the vertical baffles, which is partially shielded from pressure from above by the laterally extending pressure shields, will flow intermittently to join the vertical flow depending on the pressures present at the different locations at various points of time.

The invention also contemplates the combination, with the arrangement of swing gates as disclosed in my prior U.S. Pat. No. 4,574,989, the disclosure of which is hereby incorporated by reference. To this end, the central baffles or walls are preferably mounted to the sidewalls of the hopper by supports spaced periodically along the length of the hopper. Athwartship supports extend between the lower part of the baffles or walls at intervals to mount the swing gates.

The invention also contemplates a method of storing cargo of finely divided flowable material in an elongated hopper having opposed sides sloping inwardly and downwardly towards a long narrow gated outlet overlying a conveyor running lengthwise of the hopper, and subsequently discharging the material from the hopper. This method involves charging the hopper with the gates closed, with a mass of particulate material, while separating the material, at an intermediate zone within the mass and spaced above the outlet, along the length of the hopper, into several vertical piles merging above and below the partitioning and shielding segments of the material above the gates from compaction forces. When discharge of the cargo is desired, the gates are opened to allow the material to escape. Essentially, the material in the funnel immediately above the outlet falls through it. Then, the material from the respective piles flows into the void left by the initial flow and arching is prevented since the material is divided across the normal lines of arch formation. Preferably, the material is also baffled in the horizontal direction across part of at least one of the piles to reduce pressure on the material in it and prevent packing.

BRIEF DESCRIPTION OF THE DRAWINGS

The invention will now be described with reference to the accompanying drawings which illustrate specific embodiments, and in which:

FIG. 3 is a fragmentary perspective view showing the mounting of the swing gates from a baffle structure for preventing athwartships arch formation;

FIG. 5 is a transverse vertical cross-section through the hopper of FIGS. 3 and 4;

DESCRIPTION OF THE PREFERRED EMBODIMENTS

Figure 1:
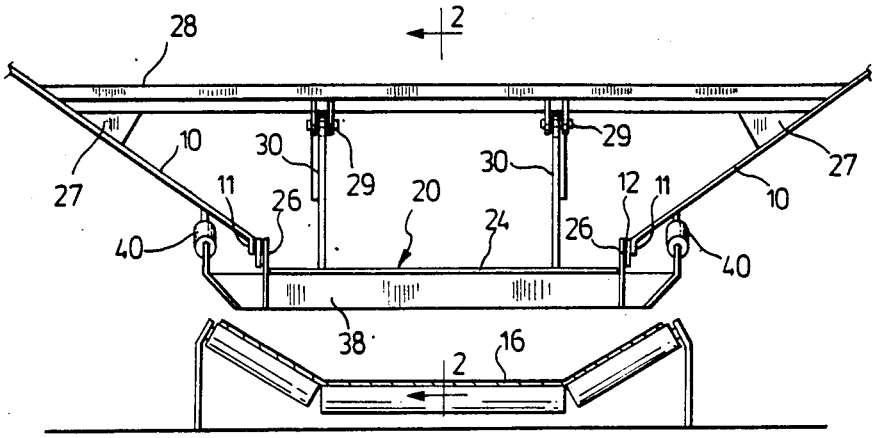
FIG. 1 is an end elevation showing gates, according to U.S. Pat. No. 4,574,989, which can be used in combination with the arrangement of the present invention for breaking up the athwartship arches.
Figure 2:
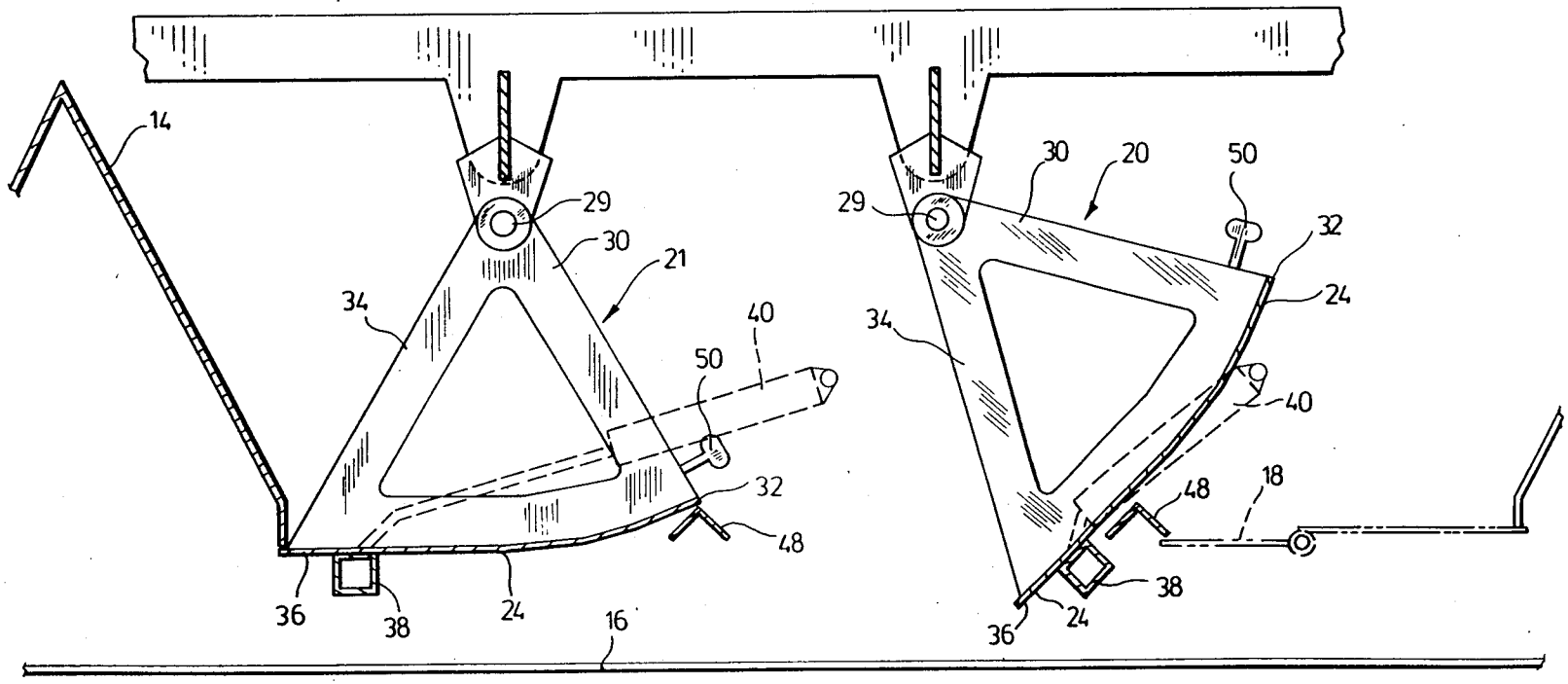
FIG. 2 is a fragmentary side elevation showing the gating of FIG. 1.

FIGS. 1 and 2 illustrate a shipboard hopper whose outlet is equipped with a cooperating plurality of swing gates according to U.S. Pat. No. 4,574,989. The gates swing, in the longitudinal direction of the hopper outlet, between closed position and open position within the hopper above the outlet. This arrangement is effective for breaking up the natural self-supporting arch of material in the longitudinal direction.

The throat opening 12 may be more or less continuous substantially along the length of the hopper, although interrupted at intervals by transverse spaced-apart members or hog backs 14 as are commonly employed in conjunction with roller track gates or basket gates for controlling flow from the hopper. A conveyor in the form of an endless belt 16 is located beneath the throat opening 12 in axial alignment with it. The conveyor belt 16 is considered to travel from right to left in FIG. 2.

The gate installation typified by FIGS. 1 and 2 is one such as may be provided in converting a roller track gate hopper system of an existing ship's hopper to a gate system in accordance with the instant invention. In such conversion the existing upstream gate, with reference to the movement of the conveyor belt 16, and shown here as a roller track gate 18, is here left substantially undisturbed. The remaining portion of throat opening 12 is gated in accordance with the improved swing gates 20,21 of the invention. Since swing gates 20,21 are identical, only the one will be particularly described and referred to, except where the context requires otherwise.

Swing gate 20 comprises a floor 24 and lateral walls 26 upstanding therefrom so as to nest within hopper wall portions 11 so as to form a closure therebetween. An elevated fixture in the form of a gate support bar 28 is anchored to lateral hopper walls 10 to span therebetween above each swing gate 20, support bar 28 being strengthened by gussets 27. Gate 20 is linked to pivot support bar 28 at coaxial pivots 29 by a superstructure in the form of laterally spaced arms 30 which connect rigidly to gate floor 24 adjacent the upstream, or forward end 32 of the gate floor, which is here that end adjacent roller track gate 18, and a second pairof laterally spaced arms 34 which connect rigidly to the gate floor 24 adjacent the other axial end 36 thereof. The axially opposed ends of arms 30,34 are interconnected with small upstanding walls 37 which tend to stiffen floor 24 in the axial direction. A transverse, tubular member 38, which forms an engaging means for the gate actuator, is rigidly secured to gate floor 24 adjacent the gate end 36 on the underside thereof so as to extend laterally beyond the distal edges of hopper wall portion 11 beneath throat 12.

Hydraulic actuators 40 connect between each end of tubular member 38 and hopper wall 10 or any point fixed relative thereto. Actuators 40 are seen in dotted outline in FIG. 2, that associated with swing gate 21 being shown in its extended position wherein the swing gate is closed, that associated with swing gate 20 being shown only in its contracted, open gate position for clarity.

Separate hydraulic control lines 42,44 are provided for independently actuating the hydraulic actuators 40 associated with swing gates 20,21 respectively. A similar control line (not shown) is provided for independently actuating roller track gate 18, no particular actuating means being here illustrated, however. Whilst it is preferable that the operation of one gate be independent of that of its neighbours, it will be appreciated that the operation of non-neighbouring gates may be interlinked without serious detriment, and the ganged operation of adjacent gates is not precluded.

Axial sealing between throat opening 12 and gate 20 is provided in the manner previously spoken of, that is to say, the upstanding walls 26 of swing gate 20 nesting closely within hopper wall portion 11 of throat opening 12. Transverse sealing is provided by stops 48 which secure to wall portions 11 so as to abut closely the first axial end 32 of one gate and the other end 36 of the adjacent gate.

The forward end portion 32 of swing gate 20 is upwardly deformed, preferably being radiused on pivot 29, although this is conveniently approximated by one or more chords in the manner generally illustrated. Stop 48 then conveniently underlays one end of floor 24 and overlays the other end of the adjacent gate. The upwardly deformed end 32 of gate 20 generally stiffens that end of the gate, end 34 being stiffened by tubular member 38. More importantly, it is found that the generally upturned end 32 of floor 24 facilitates the movement of swing gate 20 through the material contained in the hopper.

Actuation of hydraulic actuators 40 of swing gate 20 or 21 causes the gate to move about pivot 29 on a circular arc, the forward end 32 of the gate being drawn upwardly into the stored material. The locus of end 32 will depend upon the position of pivot 29 in relation to the gate opening. Generally, pivot 29 will locate intermediate the ends 32,36 of swing gate 20, the radius of the locus being such that as the swing gate moves to its fully opened position, i.e. the position assumed by gate 20 in FIG. 3, gate 21 being shown in its closed position, forward end 32 moves in vertical planes above the opening of the adjacent gate, here roller track 18.

The precise position of pivot 29 is not critical, but it will be appreciated that the actual position somewhat influences the characteristics of swing gate 20. Thus where pivot 29 locates off the axial center, towards rearward end 36 of the swing gate, the gate will tend to be normally shut, vertical penetration within the hopper increased and axial overlap of the adjacent gate decreased. Conversely, as the pivot 29 locates towards the forward end 32 of the swing gate, the gate tends to be normally open, the vertical penetration decreases and the axial overlap increases. Generally speaking, it is preferred that the axis of pivot 29 locate with the range of about 40 to 50 percent of the axial length of swing gate 20 from the forward end thereof, whereby a suitable balance between the above factors is obtained, and also whereby the swing gate when in its fully opened position least obstructs the throat opening.

The effective penetration of a swing gate within the hopper may be increased by the simple expedient of providing one or more appendages which may be in the form of protuberances as seen at 50 on forward portions of gate 20.

Having described the general mechanical principles of the embodiment of FIGS. 1 and 2, the operation thereof will be described. In the ensuing discussion, reference to gate 20 is intended to differentiate frbm gate 21. Generally speaking, in unloading the hopper,- the upstream gate will first be opened, such gate here comprising roller track gate 18. Assuming flow therethrough to become stopped or reduced through rat holes or arch formation, the actuation of the adjacent gate, here gate 20, will break out the wall of the rat hole or the arch, and the flow through gate 18 will recommence. Where it is desired to increase the flow from the hopper, gates 18 and 20 may be opened simultaneously. To some extent arches may form to bridge across gate 18 onto forward end 32 of gate 20, such arch formation may be broken by closing gate 20, so as to restart flow through gate 18. Rat hole formation will not be likely with both gates 18 and 20 open, but should it occur it can be broken by actuation of swing gate 21 in the same manner as swing gate 20 as earlier described.

Where it is desired to increase flow from the hopper still further, gates 18, 20 and 21 may each be opened. Rat hole formation and arch formation become less probable in that instance because of the increased dimension of the hopper opening in the axial direction and because the flow rate in the funnel section and throat of the hopper tends to increase disproportionately with the opening size.

The present invention is directed more particularly to breaking up the natural self-supporting arches of material in the athwartships direction and to the combination of this with breaking up the arches in the longitudinal direction.

Figure 4:
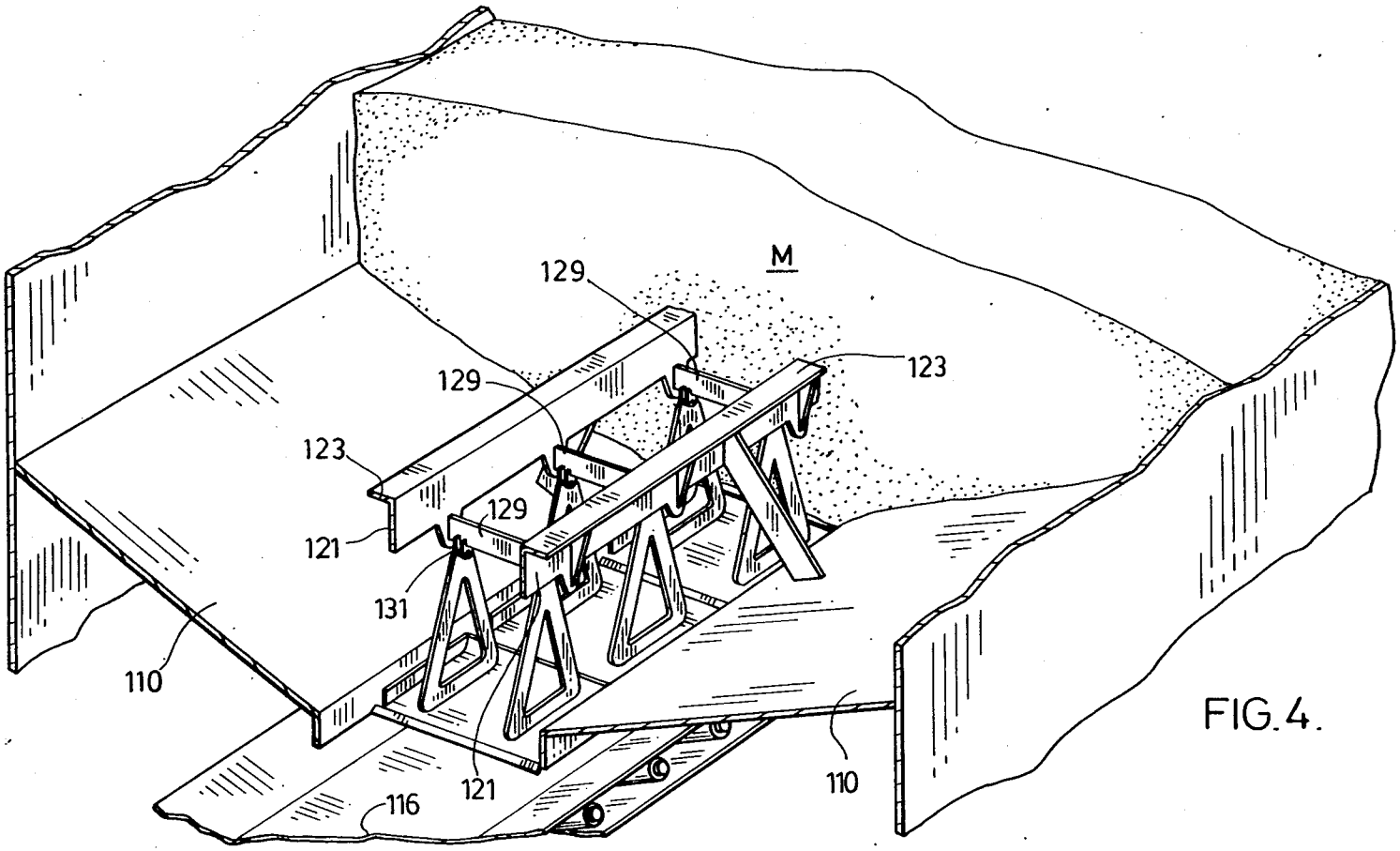
FIG. 4 is a fragmentary perspective view showing a hopper equipped with the structure for preventing the formation of athwartship arches.

FIGS. 3 and 4 are fragmentary perspective views of a hopper illustrating a preferred arrangement for preventing the formation of athwardship arches of material. Similar reference numerals, but raised by 100, identify similar parts to FIGS. 1 and 2.

This device is made up of a pair of spaced-apart elongated divider or baffle plates 121 mounted in the position shown relative to the walls of the hopper and the outlets. The plates 121 form between them a central elongated vertical channel within the cargo M of particulate material, flanked by lateral channels. Each plate 121 is preferably provided, extending outward from its upper edge, with a flange 123 constituting a pressure shield. This flange 123 may have a short downwardly extending flange 123*a* which serves to stiffen the flange to prevent it from buckling.

The gates 120, in this arrangment, are preferably mounted on arms 130, 134 pivotally mounted as at 135 on cross-bars 129 extending between the plates 121. The plates 121 are supported from the hopper wall structure 110 by spaced-apart beams 131. Each hopper wall 110 extending from a vertical bulkhead 109 to which a short terminal vertical wall 126, which with its opposed wall 126, defines the elongated hopper outlet. The operation of the gates will be clear from the structure shown in FIGS. 1 and 2 and the related description.

Figure 6:
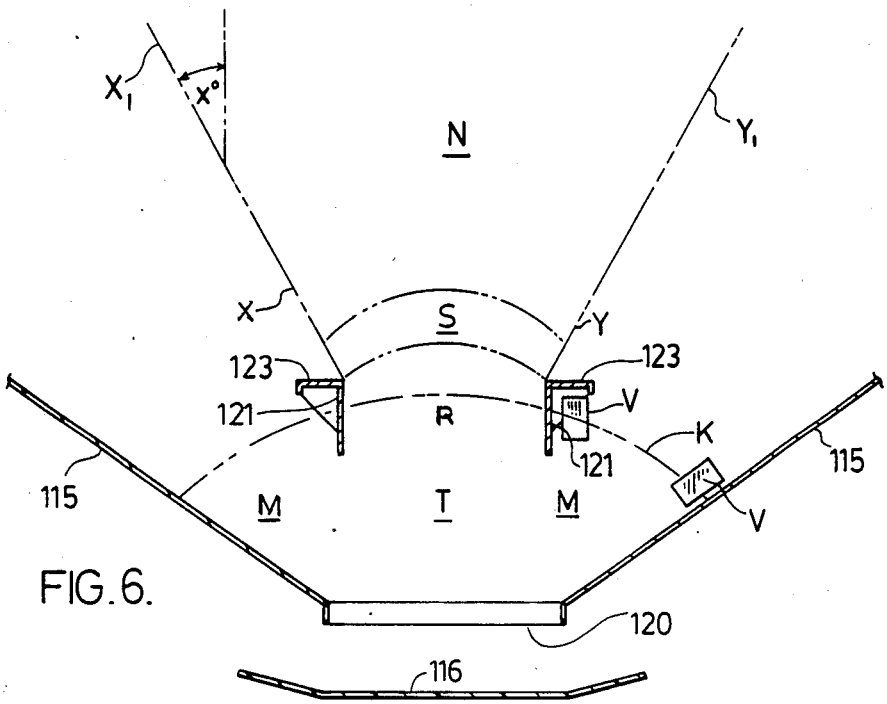
FIGS. 6 and 7 are diagrammatic illustrations showing how the structure of FIG. 4 acts to prevent athwartships arching from blocking the flow of particulate material through the outlet.

In unloading the hopper, with this arrangement, the sequence of events, as affecting the breaking up of athwardship arches during the discharge of sticky material through a bank of swing gates is illustrated diagrammatically in FIGS. 5 and 6.

The arc K indicates the bottom of a main arch of material that would, in the absence of the arch-preventing structure described, form in the mass of finely divided cargo, to prevent the flow of material from the hopper, when the gates are opened. It is to be noted that the flanges 121 and 123 intersect the arc K.

Upon opening of a gate 120, (shown in FIGS. 3 or 4) the material in zone T, (FIG. 6), immediately above the gate, drops onto the conveyor belt 116. This allows the material from the pile in zone R, between the two plates 121, to fall through the void left by the gravitation of the material from zone T and onto the belt 116.

An arch S may form in the material above zone R (FIG. 6) supported by sloughing, slip, or fracture lines Y and $Y_1$.

Figure 7:
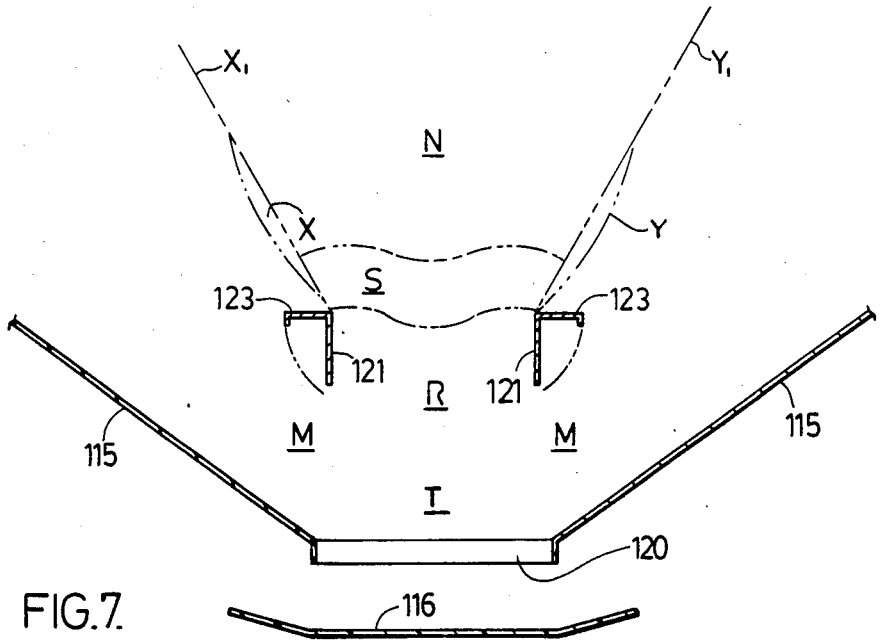

The material in part of each zone M has been protected, all along, from compaction by the weight of the material above it by one of the pressure relieving plates 123. The material in zone M is thus kept free to flow into zone T toward the open gates 120, causing a weakening and consequent sagging along the fracture lines Y, $Y_1$ by the removal of material beneath them. This will cause the arch S to collapse (see FIG. 7). This will, in turn, allow the material in the zone N, between the lines Y, $Y_1$ and X, $X_1$, to flow downward and through the open gates 120.

It may be desirable to employ a vibrator to further aid in breaking up the arch formation. In this event, the vibrator may be added close to the point where the arch meets the hopper slope, as indicated at V. Then, the vibrator will help to weaken and destroy a segment of any arch which may have formed, urging the whole arch towards collapse.

Typically, the discharge of the cargo from the hopper would be as follows. The operator would open one gate (roller track, sliding or basket) type to see if the material would flow properly. If the material arched or rat holed above that gate he would partially close the gate and partially open the adjacent swing gate. If there was still a no-flow situation the operator would partially open the next gate. The combined area of each opening of the gates being operated would be determined by the capacity of the conveyor belt being fed. In other words, the sum of the openings would be such as to provide the ideal load for the given conveyor belt.

The two, three or more lengthwise adjacent openings provide the effect of a single opening of a dimension equal to the distance between the first and last opening which will be greater than the maximum span of the self-supporting arch for that material.

The advantage of this configuration of gates is that a controlled flow can be achieved over a long span, whereas a single very large gate of equal span would allow an excess of material flow above the capacity of the belt. The swing gates moving within the material also disturbs and breaks up any arches or rat holes which may have formed in the longitudinal direction of the outlet.

The self-unloading equipment is such that cargo carried by the vessel can vary widely. The cargo can be grain, coal, gypsum, limestone, iron ore, sand, phosphate rock and other powdered, granular and lumpy material. It is important that the unloading mechanism be compatible with the particular cargo. In the event that self-unloading equipment is ineffective to unload the cargo, this can mean a lengthy tie-up of the vessel while shore equipment is employed with the very high cost to the owners of having the ship idle.

Variable Factors

The invention is particularly applicable to hoppered holds of the following preferred characteristics, for containing particulate material. Usually the slope of the hopper sides is not steep, so as to attain greater volume and thus storage capacity specially for lighter cargoes. This accelerates the arching problem. The slope of the hopper sides usually ranges from about 35° to about 50° from the horizontal.

A typical head of material in the hopper is 30 to 40 feet. Each gate opening or outlet may range from about 3 to about 5 feet in length, with 5 feet preferred and from 4½ to 6 feet in width. The baffle plates forming the vertical passage are spacedapart from about 3 to about 5 feet, preferably not more than the width of the hopper outlet. The baffle plates may be vertical or may diverge somewhat towards the bottom or may converge slightly toward the top and have a height between 2 and 5 feet. The bottom edge of the baffle plates should be 2 to 4 feet above the outlet.

The pressure shield or laterally extending flange should be from 1 to 2 feet wide and is preferably at the top of the baffle plates and can serve as a walkway, although this horizontal flange can be part way down on the upper part of the baffle plate.

The arch-inhibiting structure in a given vessel is aimed at handling the whole range of particulate materials the the vessel is likely to carry. Since each material has its own arch-forming characteristics, the structure must be adapted to handle material having arches up to those with the largest span. Ranges of operative dimensions have been given. But, the precise size and position of the baffle plates may be varied to suit particular circumstances and the optimum has to be determined by trial and error.

The height of the baffles and their position should be effective to cut across the natural arches of all materials in the range to be handled. The bottom edge of each baffle should be spaced far enough above the outlet to provide, outside it, a channel between the baffle and the sidewall of the hopper and wide enough not to unduly restrict the flow of material to the outlet. The spacing between the respective baffles should be adequate to provide a central channel of width somewhat comparable to that of the outlet, so as to allow substantial central flow of the material towards the outlet.

The working surface of the hoppers is preferably covered with plastic sheeting, decreasing the coefficient of friction. This covering may be according to the construction disclosed in U.S. Pat. No. 4,528,783, Muir, July 16, 1985.

In closing, the applicant would like to add some explanatory notes to clarify further problems involved and the way in which the invention overcomes them.

The shipboard holds and hoppers described are loaded with conveyor equipment, clams or buckets at dockside. Loading usually takes place to the point where the water reaches the loadline or plimsoll mark on the vessel. With heavy ore, the cargo may reach two-thirds of the height of the hopper. With lighter material, the hoppered holds may be full.

Once the ship sails, the cargo is subject to motion and vibration tending to consolidate the powdered materials, as described above. This is accentuated by the relatively shallow slope of shipboard hoppers. The weight of the head of material above the outlet, contributing, with the vibration, to the further settling and compacting of the material. The vessel may pass through a humid zone whereby the cargo picks up moisture. Different materials will respond differently to the forces involved as will the same materials under different conditions. There are many variables. So, the invention is geared to overcoming the most difficult conditions that can be encountered with particulate or lumpy material or combinations.

The method and apparatus of the invention provides an elongated discharge outlet so equipped with a series of gates that, to all intents and purposes, this outlet is continuous or at least has substantially continuous sections of at least 20 feet (i.e. greater than the span of the largest arch likely to form). At the same time, the tendency to form an arch in the transverse direction, under the shipboard conditions which favour this, is dealt with effectively by baffling the contents of the hopper centrally in the longitudinal direction along the entire length of the hopper, which may be up to 100 feet or so.

Usually, there are hogbacks (14 in FIG. 2) extending across the elongated outlet of the hopper. These hogbacks divide the outlet into several longitudinally aligned sections, each having a length of 3 to 5 feet. In each section there is a bank of several gates. One gate is separated from the next by an angle iron (48 in FIG. 2). When the outlet section is three feet long there may be, say, two swing gates and one sliding gate as shown in FIG. 2. If the outlet section is five feet long there may be, say, three swing gates and one sliding gate. It will be evident that the dimensions may be varied to suit the circumstances.

I claim:

1. An apparatus for storing and feeding a charge of particulate material susceptible to arch formation, comprising a hopper having a lower part provided with elongated opposed hopper walls sloping downward and converging inward towards each other to parallel margins, said hopper walls providing between them a narrowing storage space for holding a charge of particulate material and the parallel margins providing between them a long narrow discharge outlet gate means extending along the length of the outlet for maintaining it closed and opening it, in which:

there are dividing means within the hopper intersecting zones of natural transverse arch formation, said dividing means including at least a pair of spaced-apart parallel, elongated baffles extending longitudinally of the long narrow discharge outlet, the baffles being spaced from the hopper walls and above the parallel margins, mounting means between the baffles at longitudinal intervals for pivotally mounting said gate means, said gate means including a series of swing gates mounted on said mounting means for closing and opening the outlet, the gate means, when moving from closed to open position, having parts simultaneously passing through zones of natural longitudinal arch formation.

2. An apparatus, as defined in claim 1, in which the baffles include means extending horizontally above zones of natural arch formation to remove the pressure caused by the head of material thereby to maintain the flowability of material beneath.

3. An apparatus, as defined in claim 1, in which said pair of spaced-apart baffles extending in an up and down direction between the hopper walls.

4. An apparatus, as defined in claim 3, wherein the baffles are mounted from the hopper wall structure.

5. An apparatus, as defined in claim 3, in which there is a horizontal flange extending laterally from an upper part of each baffle to provide a pressure barrier to the head of material above to reduce the pressure on the material therebeneath.

6. An apparatus, as defined in claim 1, wherein a conveyor is provided below the discharge outlet and extends from an upstream end of the outlet and a slide gate is provided at the discharge outlet at least at the upstream end relative to the conveyor.

7. An apparatus for storing and feeding a charge of particulate material susceptible to arch formation, comprising, a hopper having a lower part provided with elongated opposed walls sloping downward at an angle and converging inwardly towards each other to parallel margins, the walls providing between them a narrowing space for holding particulate material and the margins providing between them a long narrow discharge outlet, gate means extending along the length of the outlet for opening and closing it, a pair of spaced-apart parallel, elongated baffles extending lengthwise of the hopper in the up and down direction between and spaced from the hopper walls, each baffle having a lower edge spaced above said margins, the baffles intersecting zones of natural transverse arch formation, mounting means between the baffles at longitudinal intervals for pivotally mounting said gate means, said gate means including a series of swing gates mounted on said mounting means for closing and opening the outlet.

8. An apparatus, as defined in claim 7, including a laterally extending flange running longitudinally along a top part of each baffle to provide a shield from compaction forces to material below it.

9. An apparatus, as defined in claim 7, in which the opposed walls slope downward at an angle between 35° and 50° from the horizontal, the discharge outlet has a width from 4½ feet to 6 feet, the baffles have a height from 2 to 5 feet, and each baffle has a lower edge spaced above the parallel margin from 2 to 4 feet.

10. An apparatus, as defined in claim 9, in which there is a laterally extending flange having a width from 1 to 2 feet running longitudinally along a top part of each baffle to provide a shield from compaction forces to material below it.

11. An apparatus as defined in claim 7, wherein a conveyor is provided below said discharge outlet and extends from an upstream end of the outlet, and a slide gate is provided at the discharge outlet at least at the upstream end relative to the conveyor.

* * * * *